US005950895A

United States Patent [19]

Zakarin

[11] Patent Number: 5,950,895

[45] **Date of Patent: *Sep. 14, 1999**

[54] BACKPACK

[75] Inventor: Lawrence J. Zakarin, Short Hills, N.J.

[73] Assignee: La Rue Distributors, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,013

[22] Filed: Dec. 17, 1997

[51] Int. Cl.[6] ..... A45F 3/04

[52] U.S. Cl. ..... 224/645; 224/627; 224/653

[58] Field of Search ..... 224/652, 653, 224/657, 627, 628, 643–647; D3/218; 206/8; 150/100, 117; 190/1, 111

[56] References Cited

U.S. PATENT DOCUMENTS

D. 205,909 10/1966 Cline .
D. 249,594 9/1978 Stewart .
D. 250,226 11/1978 Shaw .
D. 316,177 4/1991 Strimpfel .
D. 318,174 7/1991 Hanson .
D. 336,409 6/1993 Kahl et al. .
D. 339,225 9/1993 Zel .
D. 340,134 10/1993 Pollack .
D. 345,049 3/1994 Pollack .
D. 348,151 6/1994 Acheson .
D. 358,023 5/1995 Poire .
D. 360,072 7/1995 Poire .
D. 369,524 5/1996 Gunther, II et al. .
D. 396,745 8/1998 Peterson ..... D3/216
4,767,039 8/1988 Jacober .
5,209,384 5/1993 Anderson ..... 224/657
5,255,834 10/1993 Bendersky .
5,275,316 1/1994 Kish .
5,370,287 12/1994 Cormier .
5,632,429 5/1997 Cantwell ..... 224/630
5,634,576 6/1997 Arbel ..... 224/153

*Primary Examiner*—Allan N. Shoap
*Assistant Examiner*—Maerena Brevard
*Attorney, Agent, or Firm*—Mark P. Stone

[57] ABSTRACT

A carrying bag, such as a backpack, a closable primary storage compartment and at least one closable secondary storage compartment on the backpack configured in the shape of a hat, preferably a baseball cap. The carrying bag can also include additional separate closable compartments in other configurations for storing items separate from the items stored in the primary compartment.

20 Claims, 1 Drawing Sheet

BACKPACK

BACKGROUND OF THE INVENTION

The present invention is generally directed to carrying bags, particularly backpacks, commonly used by school age children and other persons. The use of backpacks worn by school children to carry items such as school books and lunches and snacks has become increasingly popular over the years. Headgear, and in particular, baseball caps, have also become popular with school age children.

It is the primary objective of the invention to provide an improved carrying bag, particularly a backpack, enabling the user to conveniently carry diverse items such as those typically carried on a regular basis by school age children and others. This object, and other objects and advantages of the present invention, will become apparent from the following description in conjunction with the drawing.

SUMMARY OF THE INVENTION

In accordance with the preferred embodiments of the invention, an improved carrying bag, particularly a backpack, includes a main storage compartment, shoulder straps extending from the main storage compartment, and a handle mounted to the top end of the main storage compartment. Means, such as one or more zippers, are provided along a seam attaching a rear wall of the main storage compartment to the sidewalls thereof for fully or partially opening the main storage compartment at the selection of the user. The bag includes one or more secondary storage compartments defined on at least one wall of the bag. These secondary storage compartments are independent of the main storage compartment and permit items stored in the secondary compartments to be separated or isolated from items stored in the main storage compartment. At least one of the secondary compartments is configured, either externally or internally, in the form of a hat, and in particular, a baseball cap, for conveniently carrying the hat in the bag separated from all other items carried in the other different compartments. Preferably, at least one secondary storage compartment is defined extending rearwardly from the rear wall of the main storage compartment so as to be facing away from, and out of contact with, the back of the user when the backpack is being worn. Although the improvements of the present invention are particularly useful in connection with backpacks, the improvements of the present invention are also useful in connection with other bags having multiple storage compartments defined therein.

DESCRIPTION OF THE PREFERRED EMBODIMENTS OF THE INVENTION

Figure 1:
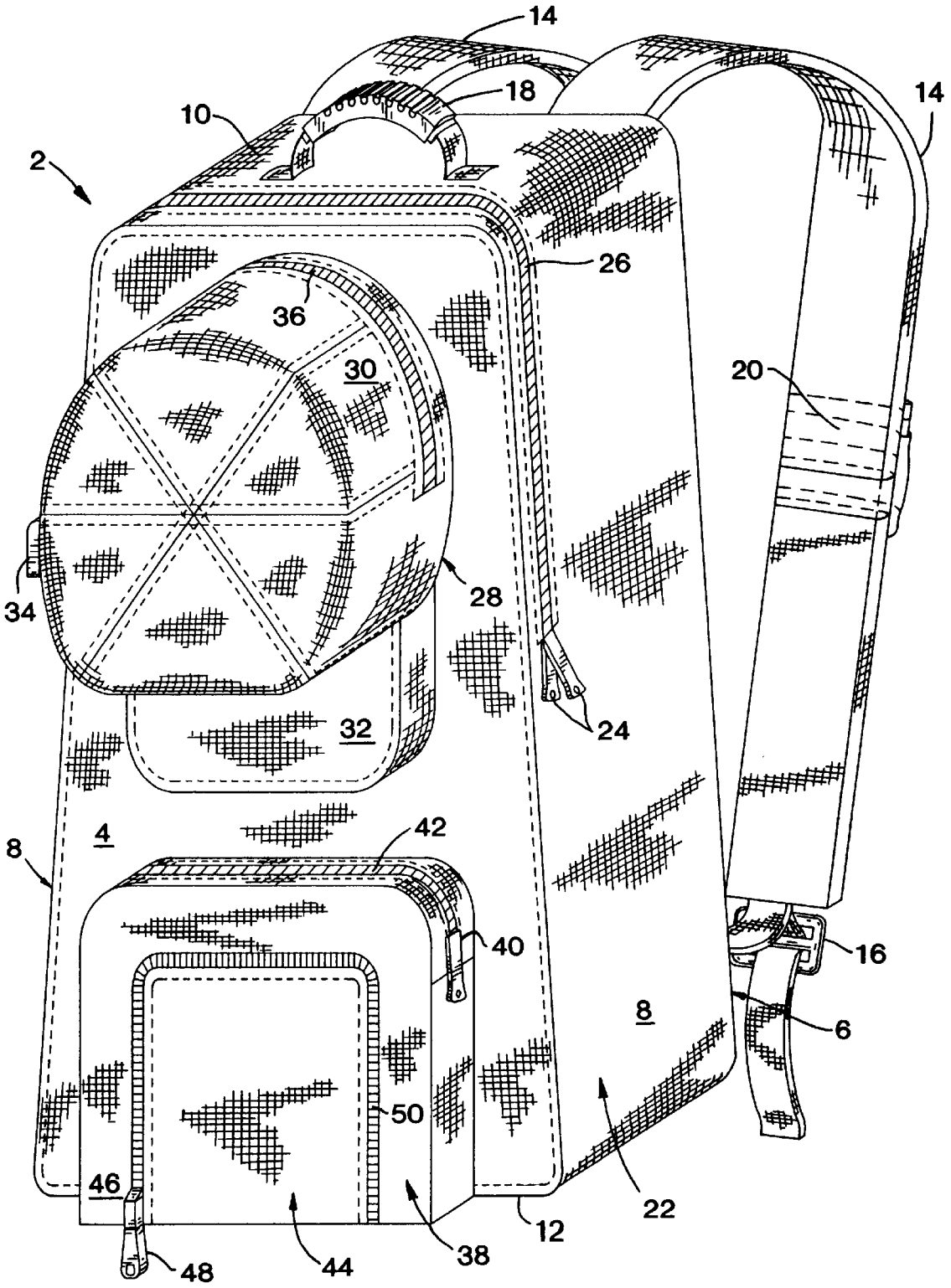
FIG. 1 of the drawing illustrates a perspective view of a backpack in accordance with the preferred embodiment of the present invention.

FIG. 1 of the drawing illustrates a perspective view of the preferred embodiment of an improved backpack in accordance with the present invention. The backpack is generally designated by reference numeral 2, and includes a rear wall generally designated by reference numeral 4, a front wall generally designated by reference numeral 6, two opposed sidewalls generally designated by reference numeral 8, a top end generally designated by reference numeral 10, and a bottom end generally designated by reference numeral 12. A pair of shoulder straps 14 extend from the rear surface 6 of the backpack, and each of the straps 14 has a buckle 16 for adjusting the strap to fit comfortably on the wearer. A handle 18 is mounted to the top end 10 of the backpack to permit the backpack to be carried or hung when it is not being worn. Preferably the backpack is formed from a durable material, such as canvas, or nylon, and the handle 18 is formed from a durable rubber or plastic material. The straps 14 are preferably formed from the same material as the main body of the backpack, and each strap includes a layer of non-skid material (such as roughened rubber) on a portion 20 of the inner surface of the strap facing the front wall 6 of the backpack to prevent the straps from shifting when the backpack is worn by the user.

The backpack 2 defines a main or primary storage compartment designated by reference numeral 22. This primary storage compartment is defined between the front wall 6, the rear wall 4, the sidewalls 8, and the top and bottom ends 10 and 12 of the backpack. Two zippers 24 are movable along a track 26 between the rear wall 4 and the side walls 8 for completely or partially opening the primary storage compartment 22, at the selection of the user, by separating the rear wall 4 from the sidewalls 8 of the backpack 2.

A secondary storage compartment, designated generally by the reference numeral 28, is configured in the shape of a baseball hat including a cap portion 30 and a visor portion 32. A zipper 34, movable along a track 36, provides means for selectively opening and closing the storage compartment 28. The storage compartment 28 extends rearwardly from the rear surface 4 of the backpack 2 such that a portion of the rear surface 4 of the backpack also forms the rear wall of the storage compartment 28. Preferably, the storage compartment 28 is formed from the same material as the primary storage compartment 22, namely durable canvass or nylon. Moreover, the secondary storage compartment 28 is preferably oriented to extend rearwardly from the rear wall 4 of the backpack so that it faces away from, and does not press against the back of the wearer, when the backpack is being worn. The secondary storage compartment is adapted to store and protect the headwear received therein in the shape of the headwear itself.

In the preferred embodiment of the invention, the external configuration of the secondary storage compartment 28 is configured in the shape of the headwear to be stored therein and extends rearwardly from the rear wall 4. The secondary storage compartment can also extend upwardly from the top wall 10, downwardly from the bottom wall 12, forwardly from the front wall 6, or outwardly from the sidewall 8. It is also within the scope of the invention to provide the secondary storage compartment with internally disposed structure configured in the shape headwear to be stored therein. In this manner, the rear surface of the secondary storage compartment 28 can be substantially flat, and the headwear is received and protected by the correspondingly shaped supporting structure within the storage compartment 28. Moreover, although the secondary storage compartment 28 is illustrated as extending rearwardly from the rear wall 4, it is within the scope of the present invention for the secondary storage compartment to extend in a forward direction into the primary storage compartment and separated therefrom by appropriate partition means so that the secondary storage compartment is defined internally within the backpack. In this manner, the entire rear surface of the backpack can be substantially planar. Similarly, the secondary storage compartment can extend internally inwardly into the primary storage compartment from the front wall, or the sidewalls, or the top wall, or the bottom wall such that the outer surface of each wall remains substantially planar. Access to the internally extending secondary storage compartment is preferably obtained internally through the primary storage compartment, but such access can also be obtained through appropriate closure means provided on the outer surfaces of any of the front, rear, top, or bottom walls.

The secondary storage compartment 28 is defined proximate to the top of the rear wall 4 of the backpack. A further secondary storage compartment, generally rectangular in shape and designated by reference numeral 38, is defined near the bottom portion of the rear wall 4 of the backpack. Storage compartment 38, like storage compartment 28, extends outwardly from the rear surface 4 of the backpack, and the rear wall of storage compartment 38 corresponds to a portion of the rear surface 4 of the backpack. A zipper 40, movable along a track 42, is provided to selectively open and close the storage compartment 38. A further secondary storage compartment, generally designated by the reference numeral 44, extends outwardly from a front surface 46 of the storage compartment 38. A zipper 48, movable along a track 50, enables the user to selectively open and close the storage compartment 44. The rear wall of the storage compartment 44 is defined by a portion of the front wall 46 of the storage compartment 38.

Although the storage compartments 28, 38 and 44 are shown as extending rearwardly from the rear surface 4 of the backpack 2, it is also within the scope of the invention to define one or more of the secondary storage compartments on one or both of the opposed sidewalls 8 or the top or bottom walls 10 and 12, instead of, or in addition to, defining these compartments on the rear surface 4.

Although not shown in the drawing, additional storage compartments, including pockets, can be defined on the front surface 6 of the backpack 2. For example, a zippered pocket for holding money, papers, or other valuable articles, can be defined on the front surface 6 of the backpack. This pocket, which will press against the back of the user when the backpack is being worn, will be substantially flat to avoid any discomfort to the user. Any pocket defined on the front surface 6 of the backpack advantageously will be both concealed and protected by the back of the user when the backpack is being worn.

As discussed herein, the backpack in accordance with the present invention is advantageous in many respects. It includes a main storage compartment in which items such as school books and the like can be accommodated, and one or more independent secondary storage compartment in which other items, such as head gear, can be stored separate from the items in the main storage compartment.

Although the preferred embodiment of the invention has been discussed with respect to backpacks, the improvements disclosed herein are applicable to other types of bags, including handbags, rolled bags (with or without closed tops) and purses, having a primary storage compartment and at least one secondary storage compartment.

Other advantages, features and modifications within the scope of the present invention disclosed herein will become apparent to those skilled in the art. Accordingly the discussion of the preferred embodiment of the backpack herein is intended to be illustrative only, and not restrictive of the scope of the invention, that scope being defined by the following claims and all equivalents thereto.

I claim:

1. A carrying bag comprising a first storage compartment and a second storage compartment, said second storage compartment having at least a portion thereof defined in a predetermined configuration for receiving therein headwear having a configuration corresponding to said predetermined configuration of said portion of said second storage compartment for storing said headwear in said second storage compartment for preventing relative movement between said headwear and said second storage compartment, said predetermined configuration comprising a first section configured in the shape of a cap and a second section merging with said first section and configured in the shape of a visor, wherein said second storage compartment is configured to receive headwear having a cap and a visor extending from the cap.

2. The carrying bag as claimed in claim 1 comprising a front wall and a rear wall, said first storage compartment defined between said front wall and said rear wall, said second storage compartment defined on one of said front and rear walls.

3. The carrying bag as claimed in claim 2 wherein said second storage compartment extends outwardly from said rear wall of said backpack.

4. The carrying bag as claimed in claim 2 wherein said second storage compartment extends inwardly from said rear wall of said backpack.

5. The carrying bag as claimed in claim 2 further including a top end disposed between said front wall and said rear wall, and a handle mounted to said top end.

6. The carrying bag as claimed in claim 2 further comprising at least one shoulder strap extending from said first storage compartment, at least a portion of said at least one shoulder strap being formed, at least in part, from an anti-slip material.

7. The carrying bag as claimed in claim 2 including at least one pocket defined in said front wall.

8. The carrying bag as claimed in claim 2 including a third storage compartment, said third storage compartment defined on said rear wall.

9. The carrying bag as claimed in claim 8 further including a fourth storage compartment defined on said third storage compartment.

10. The carrying bag as claimed in claim 1 comprising a front wall, a rear wall, and at least one sidewall disposed between said front wall and said rear wall; said first storage compartment being defined between said front wall, said rear wall, and said at least one sidewall; said second storage compartment being defined on said at least one sidewall.

11. The carrying bag as claimed in claim 1 comprising a bottom wall defining at least a portion of said first storage compartment; said second storage compartment defined, at least in part, on said bottom wall.

12. The carrying bag as claimed in claim 1 comprising a top wall defining at least a portion of said first storage compartment; said second storage compartment being defined, at least in part, on said top wall.

13. A backpack including a front wall, a rear wall, and a first storage compartment defined between said front wall and said rear wall; a second storage compartment comprising a first section configured in the shape of a cap and a second section merging with said first section and configured in the shape of a visor, wherein said second storage compartment is configured to receive headwear having a cap and a visor extending from the cap; at least one shoulder strap extending from said first storage compartment, at least a portion of said at least one shoulder strap being formed, at least in part, from an anti-slip material.

14. The backpack as claimed in claim 13 including a pair of said straps extending from said first storage compartment, at least a portion of each of said pair of straps being formed, at least in part, from an anti-slip material.

15. The backpack as claimed in claim 13 including a top end disposed between said front wall and said rear wall, and a handle mounted to said top end.

16. The backpack as claimed in claim 14 wherein said second storage compartment is defined on said rear wall and configured in the shape of a baseball cap.

17. A backpack having a front wall, a rear wall, and a first storage compartment defined between said front wall and said rear wall; a second storage compartment having at least a portion thereof defined in a predetermined configuration for receiving therein headwear having a configuration corresponding to said predetermined configuration of said portion of said second storage compartment for storing said headwear in said second storage compartment for preventing relative movement between said headwear and said second storage compartment, said predetermined configuration comprising a first section configured in the shape of a can and a second section merging with said first section and configured in the shape of a visor, wherein said second storage compartment is configured to receive headwear having a cap and a visor extending from the cap; and at least one pocket defined in said front wall.

18. The backpack as claimed in claim 17 including means for selectively closing said at least one pocket defined in said front wall.

19. The backpack as claimed in claim 17 said second storage compartment extends from said rear wall of said backpack.

20. The backpack as claimed in claim 19 including at least one shoulder strap extending from said first storage compartment, at least a portion of said at least said one strap is formed, at least in part, from an anti-slip material.

* * * * *

UNITED STATES PATENT AND TRADEMARK OFFICE

CERTIFICATE OF CORRECTION

PATENT NO. : 5,950,895

DATED : September 14, 1999

INVENTOR(S) : Lawrence J. Zakarin

It is certified that error appears in the above-identified patent and that said Letters Patent is hereby corrected as shown below:

Claim 17, Line 11 (Col. 5, Line 17):

Delete "can" and substitute - -cap- -.

Signed and Sealed this

Seventh Day of March, 2000

*Attest:*

*Attesting Officer*

Q. TODD DICKINSON

*Commissioner of Patents and Trademarks*